US010902761B2

(12) United States Patent
Ji

(10) Patent No.: US 10,902,761 B2
(45) Date of Patent: Jan. 26, 2021

(54) QUALITY DETERMINATION METHOD OF A DISPLAY PANEL, DETERMINATION SYSTEM AND COMPUTER READABLE STORAGE MEDIUM

(71) Applicants: Chongqing HKC Optoelectronics Technology Co., Ltd., Chongqing (CN); HKC Corporation Limited, Guangdong (CN)

(72) Inventor: Feilin Ji, Chongqing (CN)

(73) Assignees: Chongqing HKC Optoelectronics Technology Co., Ltd., Chongqing (CN); HKC Corporation Limited, Shenzhen (CN)

( * ) Notice: Subject to any disclaimer, the term of this patent is extended or adjusted under 35 U.S.C. 154(b) by 5 days.

(21) Appl. No.: 16/253,424

(22) Filed: Jan. 22, 2019

(65) Prior Publication Data

US 2020/0105172 A1 Apr. 2, 2020

Related U.S. Application Data

(63) Continuation of application No. PCT/CN2018/111828, filed on Oct. 25, 2018.

(30) Foreign Application Priority Data

Sep. 30, 2018 (CN) ..... 2018 1 1155680

(51) Int. Cl.
*G09G 3/00* (2006.01)

(52) U.S. Cl.
CPC ..... *G09G 3/006* (2013.01); *G09G 2320/0673* (2013.01); *G09G 2370/022* (2013.01); *G09G 2370/04* (2013.01)

(58) Field of Classification Search
CPC ..... G09G 3/006; G09G 2320/0673; G09G 2370/022; G09G 2370/04; G09G 5/00; G09G 3/3648; G09G 2320/0247
See application file for complete search history.

(56) References Cited

U.S. PATENT DOCUMENTS

| | | | | |
|---|---|---|---|---|
| 2017/0047047 | A1 | 2/2017 | Zhao | |
| 2018/0160072 | A1* | 6/2018 | Cranfill | G09G 5/14 |
| 2018/0315381 | A1* | 11/2018 | Zha | G09G 3/3607 |

FOREIGN PATENT DOCUMENTS

| | | | |
|---|---|---|---|
| CN | 101345033 | A | 1/2009 |
| CN | 101882412 | A | 11/2010 |
| CN | 107249070 | A | 10/2017 |
| CN | 108010479 | A | 5/2018 |

* cited by examiner

*Primary Examiner* — Yaron Cohen

(57) ABSTRACT

Disclosed are a data processing method, system and storage medium, the method comprising: acquiring by an equality determination device, according to a preset transmission protocol, a Gamma parameter adjusted by a Gamma adjustment device; converting the Gamma parameter into data conforming to the equality determination device; and generating an equality determination result.

7 Claims, 5 Drawing Sheets

QUALITY DETERMINATION METHOD OF A DISPLAY PANEL, DETERMINATION SYSTEM AND COMPUTER READABLE STORAGE MEDIUM

CROSS REFERENCE TO RELATED APPLICATIONS

The present application relates to the field of data processing, and in particular to a quality determination method of a display panel, system and computer readable storage medium.

FIELD OF THE DISCLOSURE

The present application relates to the field of data processing, and in particular to a data processing method, system and computer readable storage medium.

BACKGROUND OF THE DISCLOSURE

Image quality is very important for the quality of a thin film transistor liquid crystal display (TFT LCD). However, during the production of a display panel, a Gamma curve of the TFT LCD panel would deviate more or less due to the differences of processes and materials. If each display panel is required to achieve the standard of a client, a Gamma automatic adjustment system is generally required to perform automatic Gamma adjustment on each display panel. Only completing the Gamma adjustment of the display panel cannot ensure that each adjusted display panel is already adjusted to a preset standard. In the prior art, an equality determination device is further required to determine the Gamma value of the adjusted display panel.

In the prior art, a Gamma adjustment device and the equality determination device are respectively produced by two different producers; therefore, the two devices are different hugely, are incompatible, and cannot transmit data therebetween; the equality determination device requires re-detecting and acquiring the Gamma parameter of the adjusted display panel during determination, thus the determination process is bothersome.

SUMMARY OF THE DISCLOSURE

An embodiment of the application provides a data processing method, and solves the problem in the prior art that the determination process is bothersome because the Gamma adjustment device and the equality determination device are incompatible, and cannot transmit data therebetween, and the equality determination device requires re-detecting and acquiring the Gamma parameter of the adjusted display panel during determination.

In order to achieve the above aim, an embodiment of the application provides a data processing method, the data processing method comprising the steps of:

Acquiring by an equality determination device, according to a preset transmission protocol, a Gamma parameter adjusted by a Gamma adjustment device, wherein the equality determination and the Gamma adjustment device are not compatible;

Converting the Gamma parameter into data conforming to the equality determination device; and Generating an equality determination result according to preset Gamma parameters and the converted Gamma parameter.

Alternatively, before the step of acquiring by an equality determination device, according to a preset transmission protocol, a Gamma parameter adjusted by a Gamma adjustment device, the method comprises:

Generating the Gamma parameter adjusted by the Gamma adjustment device in a first format, wherein the first format is a format automatically generated by the Gamma adjustment device, and is a transmission format of the Gamma adjustment device and the equality determination device;

The step of converting the Gamma parameter into data conforming to the equality determination device comprises:

Converting by the equality determination device the Gamma parameter in the first format into a second format, wherein the second format is a format conforming to the equality determination device.

Alternatively, before the step of acquiring by an equality determination device, according to a preset transmission protocol, a Gamma parameter adjusted by a Gamma adjustment device, the method comprises:

Generating the Gamma parameter adjusted by the Gamma adjustment device in a first format, wherein the first format is a format automatically generated by the Gamma adjustment device; and Converting by the Gamma adjustment device the Gamma parameter in the first format into a second format, wherein the second format is a transmission format of the Gamma adjustment device and the equality determination device.

Alternatively, the step of converting the Gamma parameter into data conforming to the equality determination device comprises:

Parsing by the equality determination device the Gamma parameter in the second format into a third format, wherein the third format is a format conforming to the equality determination device.

Alternatively, the step of generating an equality determination result according to preset Gamma parameters and the converted Gamma parameter comprises:

The preset Gamma parameters comprise a first Gamma parameter and a second Gamma parameter, wherein the first Gamma parameter is less than the second Gamma parameter;

When the adjusted Gamma parameter is greater than or equal to the first Gamma parameter and is less than or equal to the second Gamma parameter, generating an equality determination result "pass"; and When the adjusted Gamma parameter is less than the first Gamma parameter or is greater than the second Gamma parameter, generating an equality determination result "fail".

Alternatively, the data acquired by the equality determination device from the Gamma adjustment device comprises: the identity of a display panel, a Gamma value of the display panel before the adjustment, and adjustment time of the display panel.

Alternatively, after the step of generating an equality determination result according to preset Gamma parameters and the converted Gamma parameter, the method comprises:

Storing the equality determination result;

Displaying the equality determination result; and

Uploading the equality determination result to a server for backup.

Alternatively, before the step of acquiring by an equality determination device, according to a preset transmission protocol, a Gamma parameter adjusted by a Gamma adjustment device, the method comprises:

Acquiring by the Gamma adjustment device the luminance and flicker data of the display panel;

Converting the luminance and flicker data of the display panel into a Gamma parameter; and Performing Gamma adjustment on the display panel according to the Gamma parameter.

In addition, in order to achieve the above aim, an embodiment of the application further provides a data processing system, the data processing system comprising a memory, a processor, and a data processing program stored in the memory and capable of running on the processor, wherein when the data processing program is executed by the processor, the above-described steps of the data processing method are realized.

In addition, to achieve the above object, the embodiments of the application further provide a computer readable storage medium, the computer readable storage medium being stored with a data processing program, wherein when the data processing program is executed by a processor, the above-described steps of the data processing method are realized.

In the embodiments of the application, the equality determination device can convert a Gamma parameter into data conforming to the equality determination device via a transmission protocol preset between the Gamma adjustment device and the equality determination device, such that the equality determination device can acquire a Gamma parameter of the adjusted display panel transmitted by the Gamma adjustment device, and can read and utilize the Gamma parameter after the Gamma parameter is converted, thus the equality determination device can determine the Gamma parameter of the adjusted display panel, and finally generate an equality determination result. Therefore, during the determination of the equality determination device of the application, the Gamma data transmitted by the Gamma adjustment device can be directly utilized without re-detecting and acquiring the Gamma value of the adjusted display panel, thus simplifying the determination process of the equality determination device. Furthermore, in the prior art, the equality determination device and the Gamma adjustment device are respectively located at two different stations; when performing equality determination on a display panel, the display panel is required to be transported from the station at which the Gamma adjustment device is located to the station (namely the next station) at which the equality determination device is located, and then the Gamma value of the display panel is acquired through re-detection, therefore the determination process is bothersome. In the application, the equality determination device and the Gamma adjustment device can be disposed in the same station, thus avoiding the problem of bothersome determination process in the prior art.

DETAILED DESCRIPTION OF THE EMBODIMENTS

It should be understood that the specific embodiments described herein are only for illustrating but not for limiting the present application.

The technical problem to be solved by the present application is: in the prior art, the Gamma adjustment device and the equality determination device are incompatible, and cannot transmit data therebetween; the equality determination device requires re-detecting and acquiring the Gamma parameter of the adjusted display panel during determination, thus the determination process is bothersome. In the technical solution of the present application, the Gamma adjustment device and the equality determination device can transmit data therebetween, thus simplifying the Gamma value determination process of the equality determination device.

In an illustrative technique, the Gamma adjustment device for adjusting the display panel and the equality determination for determining whether the Gamma value of the adjusted display panel is compliant are respectively located at two different stations. Wherein the Gamma adjustment device first adjusts the display panel. After the Gamma adjustment device completes the adjustment, the display panel is required to be transported to the station (namely the next station) at which the equality determination device is located. Before the determination of the equality determination device, the Gamma value of the adjusted display panel is required to be re-detected and acquired; during determination, the equality determination device compares the acquired Gamma value of the adjusted display panel with a preset value, and determines the Gamma value of the display panel, namely generates an equality determination result "pass" or "fail".

Figure 1:
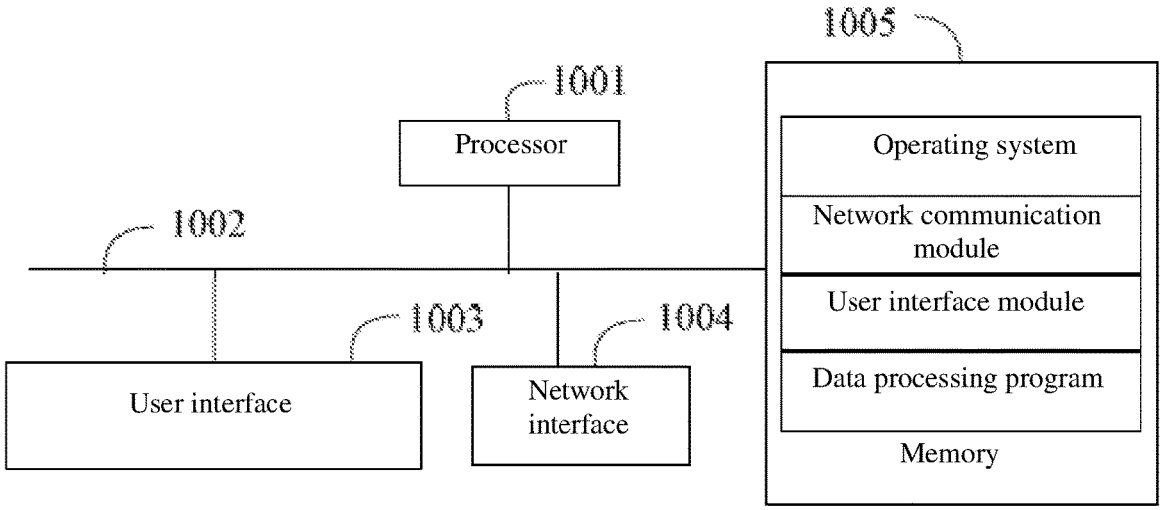
FIG. 1 is a structural schematic view of a terminal in a hardware running environment according to a solution in an embodiment of the present application.

As shown in FIG. 1, FIG. 1 is a structural schematic view of a terminal in a hardware running environment according to a solution in an embodiment of the present application.

The terminal in the embodiment of the present application can be a personal computer (PC), and can also be a tablet computer, a portable computer, a server or other terminal devices.

As shown in FIG. 1, the terminal may comprise a processor 1001 such as a central processing unit (CPU), a network interface 1004, a user interface 1003, a memory 1005 and a communication bus 1002, wherein the communication bus 1002 is configured to realize connection and communication between the assemblies; the user interface 1003 may comprise a display screen, and an input unit such as a keyboard; alternatively, the user interface 1003 may further comprise a standard wired interface and a standard wireless interface; the network interface 1004, alternatively, may comprise a standard wired interface and a standard wireless interface (such as a WiFi interface); the memory 1005 can be a high-speed RAM memory, and can also be a non-volatile memory, such as a magnetic disk memory; and the memory 1005, alternatively, can also be a storage apparatus independent from the processor 1001.

A person skilled in the art may understand that the terminal structure shown in FIG. 1 does not limit the terminal, and the terminal may comprise more or less components as shown in the figure, or have combinations of certain components or different arrangement of components.

As shown in FIG. 1, the memory 1005, as a computer storage medium, may comprise an operating system, a network communication module, a user interface module and a data processing program.

In the terminal as shown in FIG. 1, the network interface 1004 is mainly configured to connect to a background server and communicate data with the background server; the user interface 1003 is mainly configured to connect to a client terminal and communicate data with the client terminal; and the processor 1001 can be configured to invoke the data processing program stored in the memory 1005, and execute the data processing method provided by the embodiment of the present application.

Figure 3:
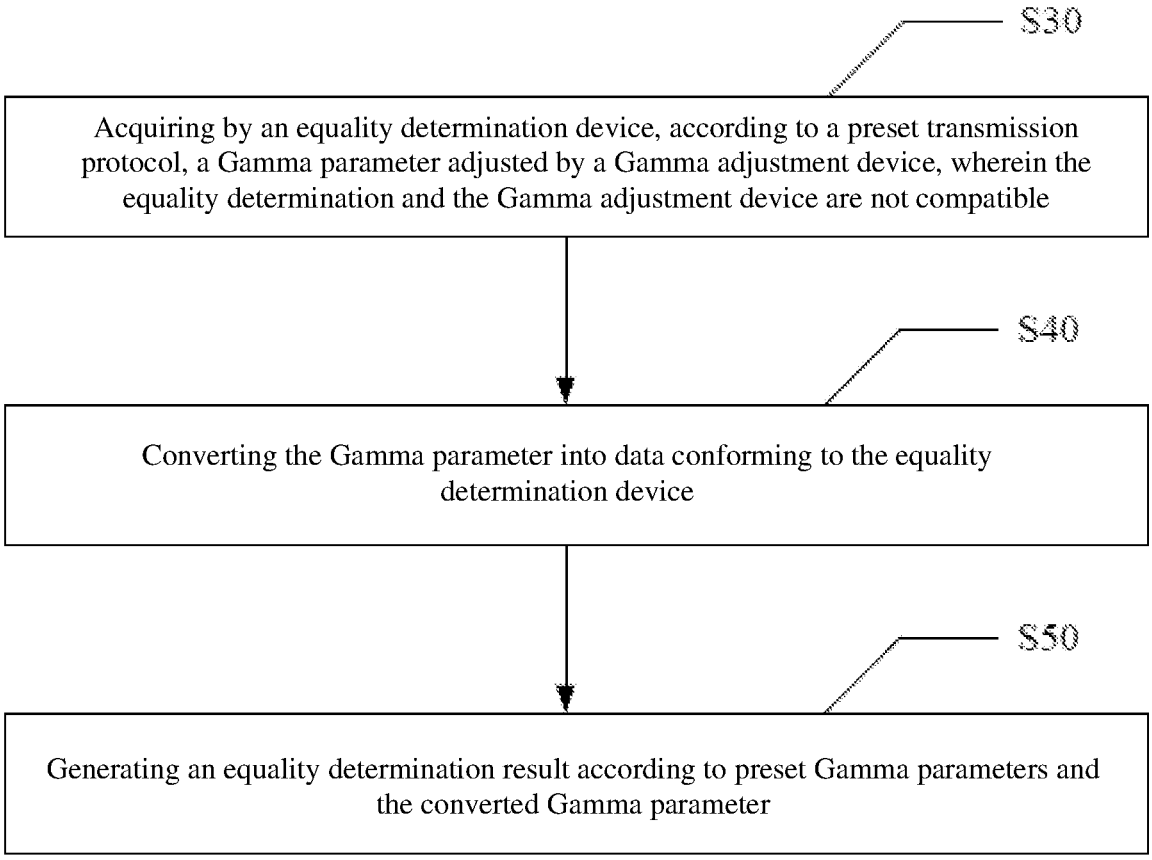
FIG. 3 is a flow chart of the first embodiment of the data processing method according to the present application.

To achieve the above object, as shown in FIG. 3, an embodiment of the present application provides a data processing method, the data processing method comprising the following steps:

Step S30, acquiring by an equality determination device, according to a preset transmission protocol, a Gamma parameter adjusted by a Gamma adjustment device, wherein the equality determination and the Gamma adjustment device are not compatible;

To be specific, the Gamma adjustment device is configured to adjust the Gamma value of the display panel to be a preset format; and the equality determination device is configured to determine the Gamma value. In the embodiment, the equality determination device and the Gamma adjustment device establish a communication connection therebetween. The Gamma adjustment device is produced by a producer A, and the equality determination is produced by a producer B. In the embodiment, the producer A and the producer B can negotiate to define a data transmission protocol together, such that the incompatible Gamma adjustment device and the equality determination device can transmit data therebetween, and the data such as the Gamma parameter generated after the Gamma adjustment device adjusts the display panel can be transmitted to the equality determination device. Therefore, in the present application, the Gamma adjustment device and the equality determination device can be disposed in the same station; namely, in the same station, Gamma adjustment can be performed on the display panel via the Gamma adjustment device, and the Gamma value of the adjusted display panel can be determined via the equality determination device.

Step S40, converting the Gamma parameter into data conforming to the equality determination device;

To be specific, the Gamma adjustment device can transmit the data such as the Gamma parameter and the like to the equality determination device; and the equality determination can convert the data into the data conforming to the equality determination device, namely the data that the equality determination device can read. For example, the equality determination device can save the data such as the Gamma parameter and the like transmitted by the Gamma adjustment device as a TXT document (the process is equivalent to data conversion), such that the equality determination device can read and utilize the Gamma parameter in the document in the storage format TXT.

Step S50, generating an equality determination result according to preset Gamma parameters and the converted Gamma parameter.

To be specific, the equality determination comprises a personal computer (PC), wherein equality determination software is installed on the PC; a determination program is set by the equality determination software. For example, the equality determination software sets a control range to be Gamma 2.2±0.2; the Gamma parameter received by the equality determination device is compared with the control range set by the equality determination software; if the Gamma parameter is in the range 2.2±0.2, then automatically obtaining the equality determination result "pass"; and if the Gamma parameter is not in the range 2.2±0.2, then obtaining the equality determination result "fail". With the method, the Gamma value of the detected display panel can be determined; certainly, the control range of the Gamma value can be set as required according to specific situations.

In the embodiments of the present application, the equality determination device can convert a Gamma parameter into data conforming to the equality determination device via a transmission protocol preset between the Gamma adjustment device and the equality determination device, such that the equality determination device can acquire a Gamma parameter of the adjusted display panel transmitted by the Gamma adjustment device, and can read and utilize the Gamma parameter after the Gamma parameter is converted, thus the equality determination device can determine the Gamma parameter of the adjusted display panel, and finally generate an equality determination result. Therefore, during the determination of the equality determination device of the present application, the Gamma data transmitted by the Gamma adjustment device can be directly utilized without re-detecting and acquiring the Gamma value of the adjusted display panel, thus simplifying the determination process of the equality determination device. Furthermore, in the prior art, the equality determination device and the Gamma adjustment device are respectively located at two different stations; when performing equality determination on a display panel, the display panel is required to be transported from the station at which the Gamma adjustment device is located to the station (namely the next station) at which the equality determination device is located, and then the Gamma value of the display panel is acquired through re-detection, therefore the determination process is bothersome. In the present application, the equality determination device and the Gamma adjustment device can be disposed in the same station, thus avoiding the problem of bothersome determination process in the prior art.

Figure 4:
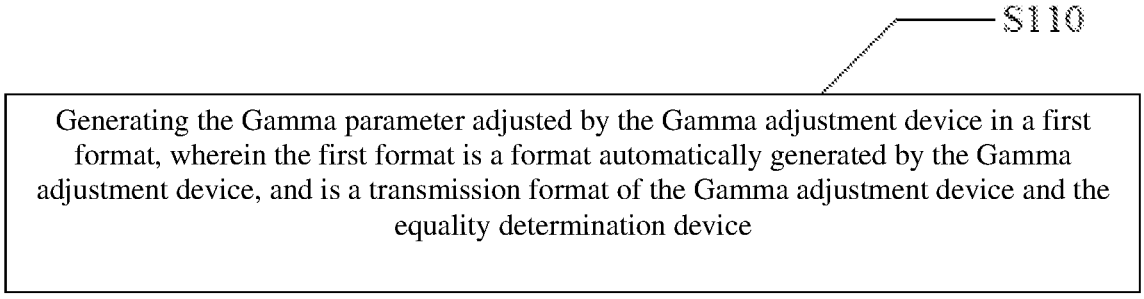
FIG. 4 is a flow chart of the second embodiment of the data processing method according to the present application.
Figure 5:
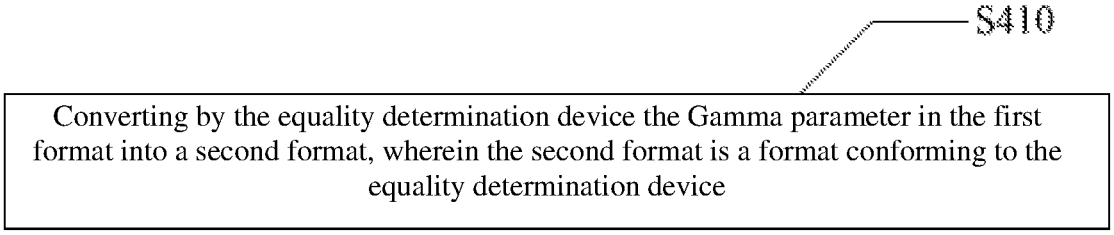
FIG. 5 is a flow chart of the third embodiment of the data processing method according to the present application.

For the solution design how the Gamma adjustment device and the equality determination device transmit data and convert data format, in one embodiment, as shown in FIGS. 4 and 5, before the step S30, the method comprises:

Step S110, generating the Gamma parameter adjusted by the Gamma adjustment device in a first format, wherein the first format is a format automatically generated by the Gamma adjustment device, and is a transmission format of the Gamma adjustment device and the equality determination device;

The step S40 comprises:

Step S410, converting by the equality determination device the Gamma parameter in the first format into a second format, wherein the second format is a format conforming to the equality determination device.

To be specific, the Gamma adjustment device producer A and the equality determination device producer B negotiate to define a transmission protocol together; when the first format is the transmission format of the Gamma adjustment device and the equality determination device, and the first format is the generation format of the Gamma adjustment device, the transmission format of the Gamma adjustment device shall prevail; when the equality determination device receives data in the first format from the Gamma adjustment device, the equality determination device can convert the Gamma parameter in the first format into the second format conforming to the equality determination device. For example, the equality determination device can save the received data such as the Gamma parameter and the like as a TXT document (the process is equivalent to data conversion), such that the equality determination device can utilize the Gamma parameter having been adjusted by the Gamma adjustment device to perform determination, thus reducing the step of re-detecting and acquiring the Gamma value of the display panel, and simplifying the determination process of the equality determination device.

Figure 6:
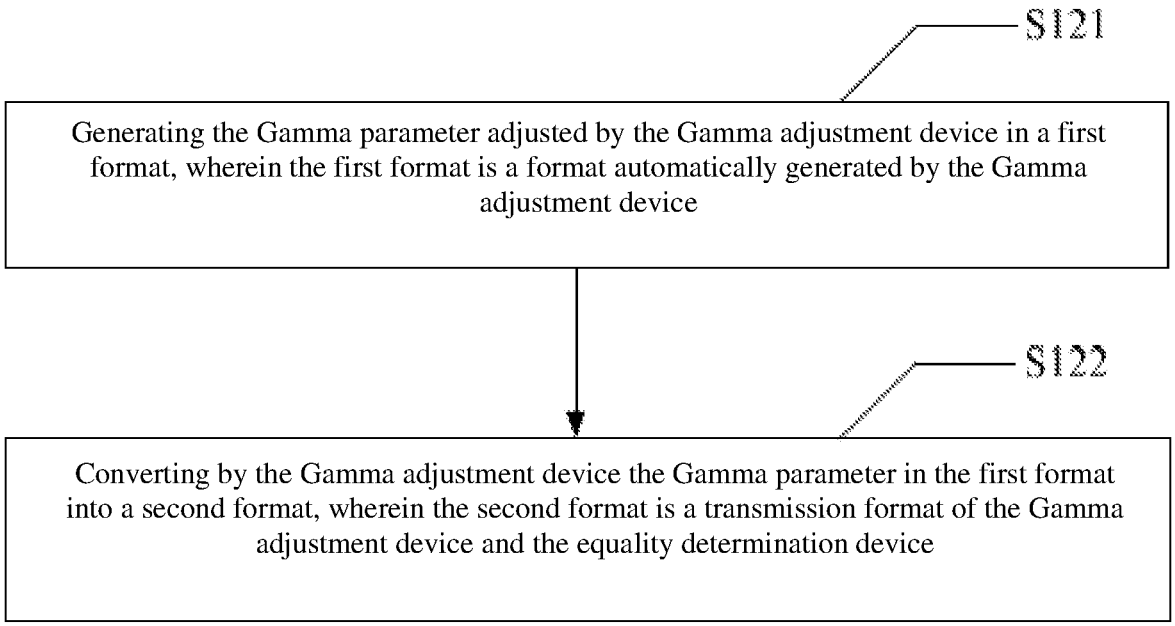
FIG. 6 is a flow chart of the fourth embodiment of the data processing method according to the present application.

In another embodiment, as shown in FIG. 6, before the step S30, the method comprises:

Step S121, generating the Gamma parameter adjusted by the Gamma adjustment device in a first format, wherein the first format is a format automatically generated by the Gamma adjustment device; and Step S122, converting by the Gamma adjustment device the Gamma parameter in the first format into a second format, wherein the second format is a transmission format of the Gamma adjustment device and the equality determination device.

To be specific, the Gamma adjustment device producer A and the equality determination device producer B negotiate to define a transmission protocol together; when the second format is the transmission format of the Gamma adjustment device and the equality determination device, and the first format is the generation format of the Gamma adjustment device, the transmission format is inconsistent with the format of the Gamma adjustment device, in which case the Gamma adjustment device converts the Gamma parameter in the first format into the data in the second format, thus satisfying a transmission condition. The Gamma adjustment device can transmit the converted data in the second format to the equality determination, thus realizing the data transmission between the Gamma adjustment device and the equality determination device.

Figure 7:
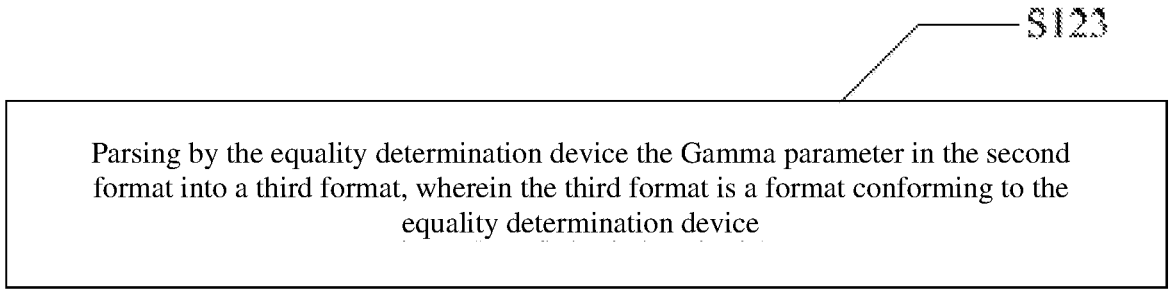
FIG. 7 is a flow chart of the fifth embodiment of the data processing method according to the present application.

As shown in FIG. 7, the step S40 comprises:

Step S123, parsing by the equality determination device the Gamma parameter in the second format into a third format, wherein the third format is a format conforming to the equality determination device.

To be specific, when the equality determination device receives data in the second format from the Gamma adjustment device, the equality determination device can convert the Gamma parameter in the second format into the third format conforming to the equality determination device. For example, the equality determination device can save the received data such as the Gamma parameter and the like as a TXT document (the process is equivalent to data conversion), such that the equality determination device can utilize the Gamma parameter having been adjusted by the Gamma adjustment device to perform determination, thus reducing the step of re-detecting and acquiring the Gamma value of the display panel, and simplifying the determination process of the equality determination device.

Figure 8:
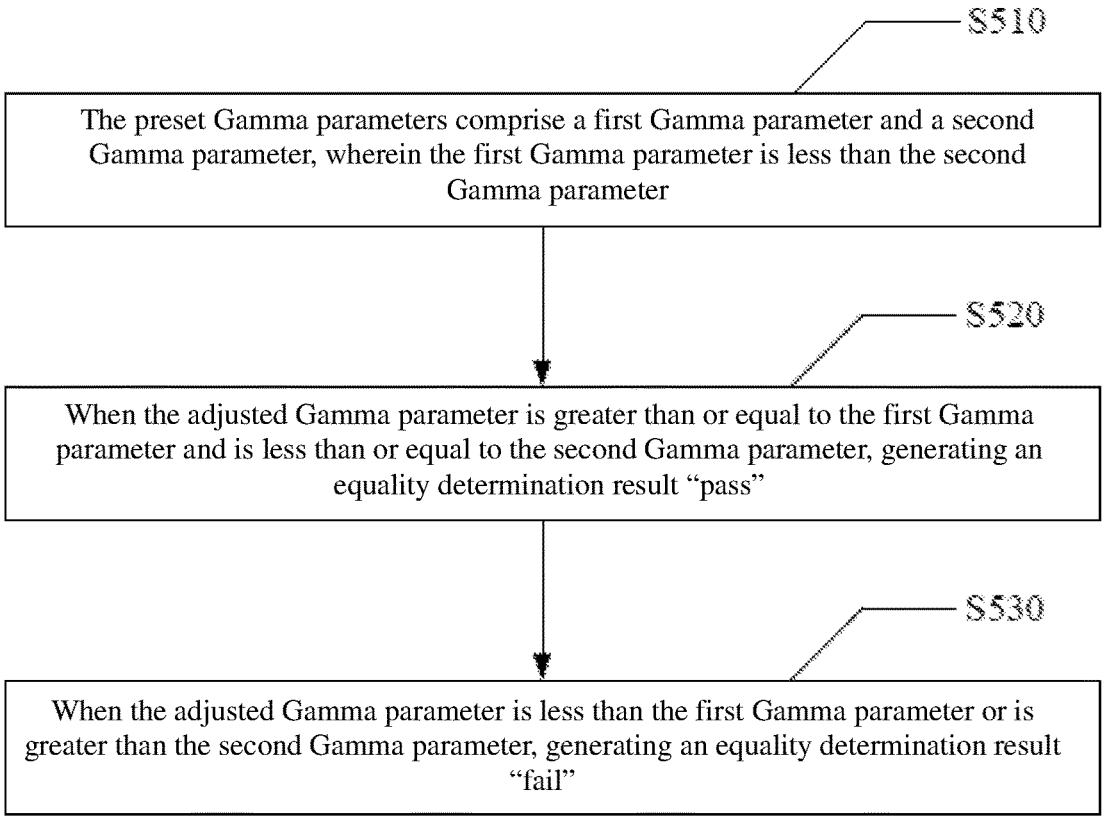
FIG. 8 is a flow chart of the sixth embodiment of the data processing method according to the present application.

As shown in FIG. 8, the step S50 comprises:

Step S510, the preset Gamma parameters comprise a first Gamma parameter and a second Gamma parameter, wherein the first Gamma parameter is less than the second Gamma parameter;

Step S520, when the adjusted Gamma parameter is greater than or equal to the first Gamma parameter and is less than or equal to the second Gamma parameter, generating an equality determination result "pass"; and Step S530, when the adjusted Gamma parameter is less than the first Gamma parameter or is greater than the second Gamma parameter, generating an equality determination result "fail".

To be specific, for example, when the equality determination software installed in the PC of the equality determination device sets the control range to be Gamma 2.2±0.2, namely when Gamma 2.2−0.2 is the first Gamma parameter and Gamma 2.2+0.2 is the second Gamma parameter, the adjusted Gamma parameter received by the equality determination device is compared with the control range set by the equality determination software; if the adjusted Gamma is greater than or equal to the first Gamma parameter and is less than or equal to the second Gamma parameter, then automatically obtaining the equality determination result "pass"; and if the adjusted Gamma parameter is less than the first Gamma parameter or is greater than the second Gamma parameter, then automatically obtaining the equality determination result "fail". With the method, the Gamma value of the detected display panel can be determined, and the accuracy of the equality determination result can be ensured; certainly, the control range of the Gamma value can be set as required according to specific situations.

Alternatively, the data acquired by the equality determination device from the Gamma adjustment device comprises: the identity of a display panel, a Gamma value of the display panel before the adjustment, and adjustment time of the display panel.

To be specific, the data such as the equality determination result "pass" or "fail" of the display panel, the identity (ID) of the display panel, the Gamma value of the display panel before the adjustment, the Gamma value of the display panel after the adjustment, and adjustment time of the display panel and the like are displayed at the PC terminal of the equality determination device for a person on site to read and acquire, thus facilitating the subsequent saving, tracing or utilization of the display panel related information.

Figure 9:
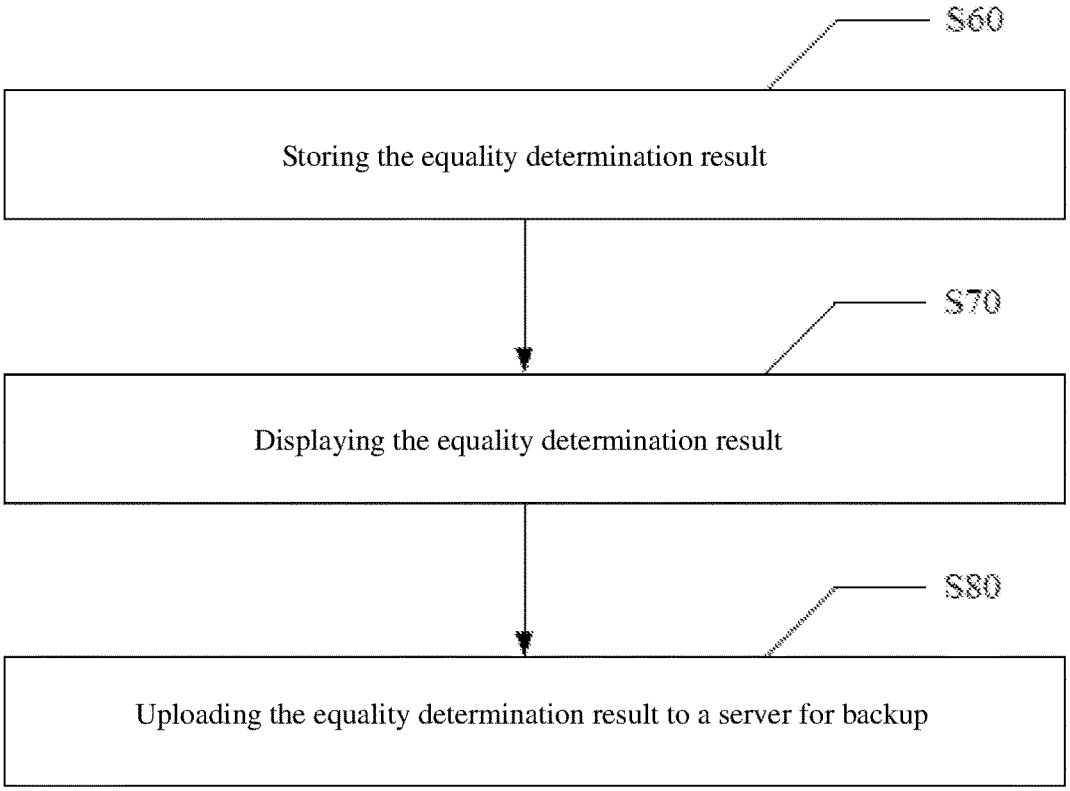
FIG. 9 is a flow chart of the seventh embodiment of the data processing method according to the present application.

As shown in FIG. 9, after the step S50, the method comprises:

Step S60, storing the equality determination result;

Step S70, displaying the equality determination result; and

Step S80, uploading the equality determination result to a server for backup.

To be specific, when the adjusted Gamma parameter of the display panel is in the preset Gamma parameter range, the equality determination result is pass; and when the adjusted Gamma parameter of the display panel is not in the preset Gamma parameter range, the equality determination result is fail. Certainly, the equality determination result may not only comprise pass or fail, and may further comprise the parameters such as the identity (ID) of the display panel, the Gamma value of the display panel before the adjustment, the Gamma value of the display panel after the adjustment, and adjustment time of the display panel and the like. Namely, the Gamma parameter detected by the Gamma adjustment device before the display panel is adjusted is transmitted to the equality determination device; the first Gamma parameter detected by the Gamma adjustment device after the display panel is adjusted is transmitted to the equality determination device; and the Gamma adjustment device transmits the ID of the display panel to the equality determination device. After the equality determination device generates an equality determination result, the equality determination result is stored in a local hard disk of the PC of the equality determination device, thus facilitating the display, saving and subsequent utilization of the equality determination result.

Further, the PC of the equality determination device can upload the equality determination result to a server via a network, thus facilitating the recording, subsequent tracing, search and analysis of the data of the display panel; furthermore, the equality determination result of the display panel can also be downloaded and utilized via a cloud server.

Figure 10:
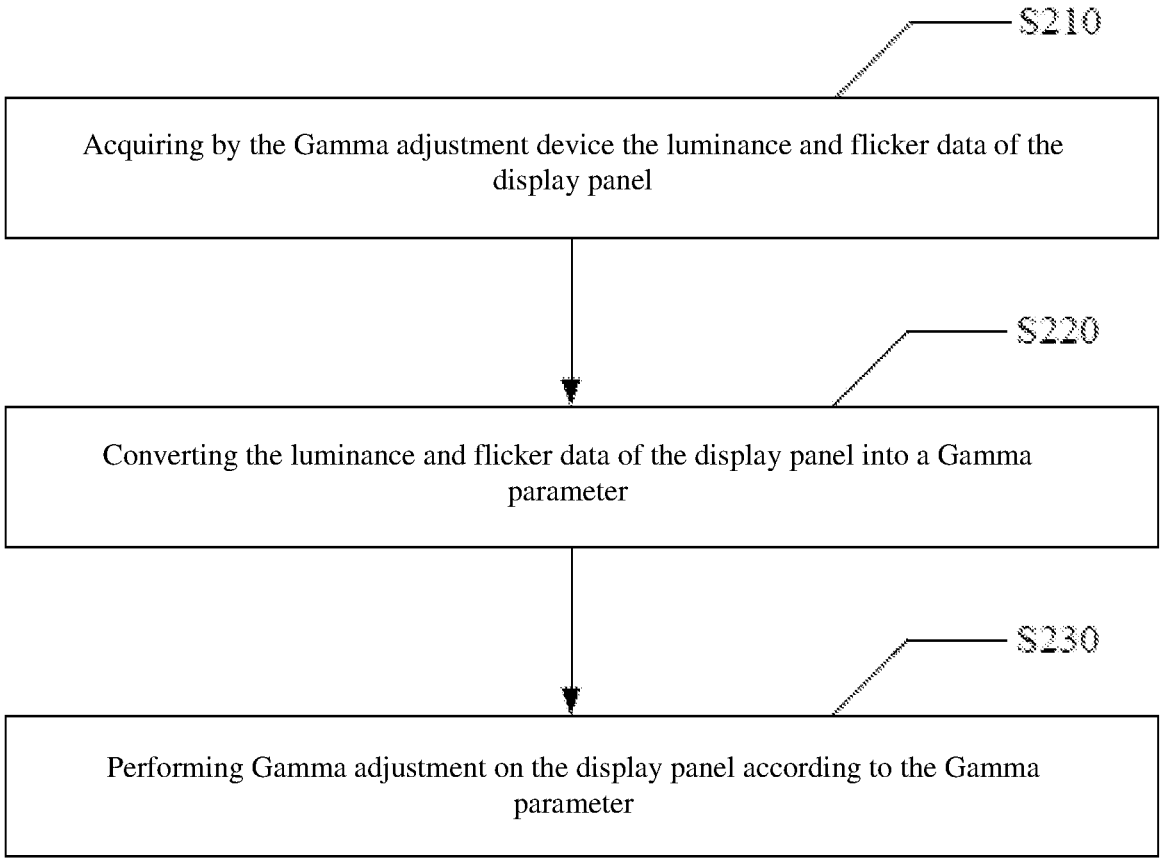
FIG. 10 is a flow chart of the eighth embodiment of the data processing method according to the present application.

As shown in FIG. 10, before the step S30, the method comprises:

Step S210, acquiring by the Gamma adjustment device the luminance and flicker data of the display panel;

Step S220, converting the luminance and flicker data of the display panel into a Gamma parameter; and Step S230, performing Gamma adjustment on the display panel according to the Gamma parameter.

Figure 2:
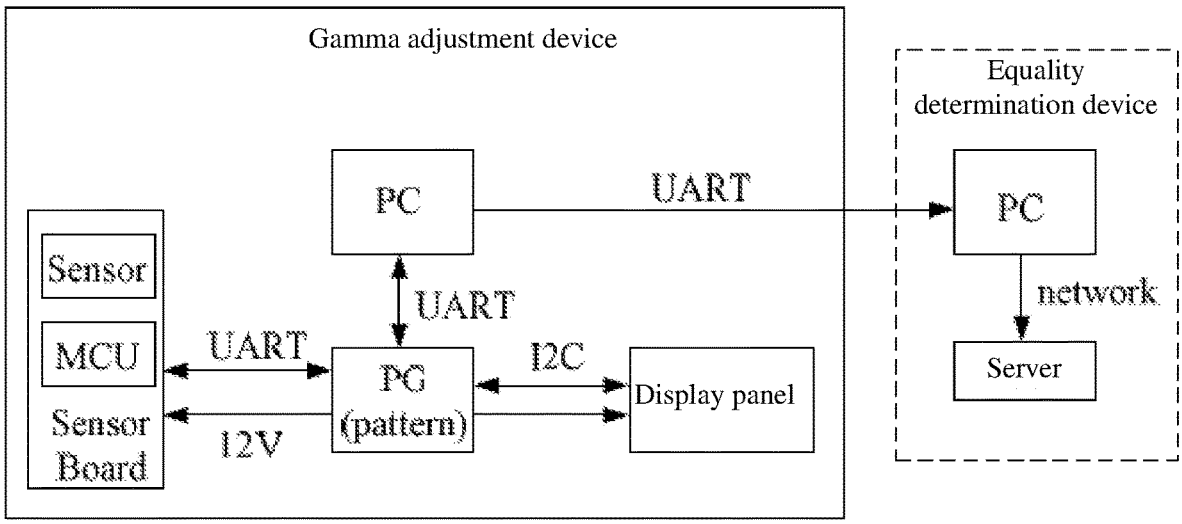
FIG. 2 is structural schematic view showing the connection between the Gamma adjustment device and the equality determination device according to a solution in an embodiment of the present application.

To be specific, as shown in FIG. 2, the Gamma adjustment device comprises a pattern generator (PG), a sensor board, a PC, and a display panel the Gamma parameter of which is required to be adjusted, wherein the effects of the sensor board are measuring the luminance of the display panel via a sensor lens, and converting into a specific luminance value.

Wherein the sensor board acquires the luminance and flicker data of the display panel, performs calculation via a micro-controller unit (MCU) thereof, and then transmits the data to the PG via a universal asynchronous receiver/transmitter (UART, a part of computer hardware, and an interface of a computer communicating with the other devices); the sensor board is electrically connected to the PG, and is powered via the PG (12V wire in FIG. 2);

The PG, on one hand, transmits the data acquired by the sensor board to the PC, on the other hand transmits a picture to the display panel, and is in communication with a digital Gamma module on the display panel via an I2C conversion interface (a bidirectional two-wire synchronous serial bus, capable of transmitting information between devices connected to the bus via only two wires);

Auto Gamma adjustment software is installed on the PC; the PC can automatically perform Gamma adjustment via the auto Gamma software, and is in communication with the PG via the UART interface. In addition, the PC transmits a Gamma automatic adjustment result (which specifically comprises the parameters such as the ID of the display panel, the Gamma value of the display panel before the adjustment, the Gamma value of the display panel after the adjustment, and the adjustment time of the display panel and the like) to the PC of the equality determination device via the UART interface. Wherein once the Gamma value of the display panel is adjusted, a digital preset value in the memory of a P-gamma (programmable Gamma correction and buffer circuit wafer) IC (integrated circuit) would change, and an outputted Gamma voltage and a VCOM voltage would change; accordingly, the Gamma curve of the display panel would change. With the method, the Gamma value of the display panel can be adjusted to the preset value.

Further, the Gamma adjustment device can also be assigned with a determination program via which the Gamma value of the adjusted display panel can be preliminarily determined; when the Gamma value is not in the preset format, the Gamma value of the display panel is continuously adjusted; when the Gamma value of the display panel is already in the preset format, the adjustment process is over; afterwards, the equality determination result made by the determination program is transmitted to the equality determination device via the PC of the Gamma adjustment device; the equality determination device determines the equality determination result; if the equality determination result passes authentication, then the PC of the equality determination device displays the equality determination result; if the equality determination result does not pass authentication, then the equality determination device determines the Gamma value of the adjusted display panel, re-determines a equality determination result, and displays the equality determination result for a person on site to read.

In addition, the embodiments of the present application further provide a data processing system.

The data processing system of the present application comprises a memory, a processor, and a data processing program stored in the memory and capable of running on the processor, wherein when the data processing program is executed by the processor, the above-described steps of the data processing method are realized.

Wherein the method realized when the data processing program is executed can refer to the embodiments of the data processing method in the present application, and will not be repeated here.

In addition, the embodiments of the present application further provide a computer readable storage medium.

The computer readable storage medium of the present application is stored with a data processing program, wherein when the data processing program is executed by a processor, the above-described steps of the data processing method are realized.

Wherein the method realized when the data processing program is executed can refer to the embodiments of the data processing method in the present application, and will not be repeated here.

A person skilled in the art should understand that the embodiment of the invention can be provided as a method, a system or a computer program product. Therefore, the present application can adopt the forms of an entirely hardware embodiment, an entirely software embodiment or an embodiment combining hardware and software elements. Furthermore, the present application can adopt the form of a computer program product which can be executed by one or more computer usable storage mediums containing computer usable program codes therein (including but not limited to magnetic disk memory, CD-ROM, and optical memory).

The present application is described with reference to the flow charts and/or block diagrams of the method, device (system) and computer program product according to the embodiments of the present application. It will be understood that each flowchart and/or block in flowchart illustrations and/or block diagrams and the combination between flowchart and/or block in flowchart illustrations and/or block diagrams can be achieved by computer program instructions. These computer instructions can be provided to a general-purpose computer, a specialized computer, an embedded processor, or the processor of other programmable data processing devices so as to give rise to a machine, with the result that the instructions executed through the computers or the processor of other programmable data processing devices give rise to a device that is configured to realize the functions designated by one or more flows in a flow chart and/or one or more blocks in a block diagram.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the specified function in a flow chart and/or one or more blocks in a block diagram.

Such computer program instructions can also be loaded to computers or other programmable data processing devices so as to execute a series of operation steps on the computers or the other programmable devices to generate a process to be achieved by computers, such that the instructions to be executed by the computers or the other programmable devices can provide a step that is configured to realize the functions designated by one or more flows in a flow chart and/or one or more blocks in a block diagram.

It should be noted that in the claims, any reference symbols in brackets shall not constitute a restriction to the claims. The word "comprise" does not exclude the components or steps not listed in the claims. The word "one" or "a/an" in front of a component does not exclude the existence of a plurality of such components. The present application can be realized by means of hardware comprising a plurality of different components and a properly-programmed computer. In a unit claim listing a plurality of devices, the plurality of the devices can be specifically embodied through the same hardware. The use of the words "1st", "2nd", "3rd" and the like do not denote any sequence. The words can be interpreted as name.

Although preferred embodiments of the present application are already described, once basic creative concepts are understood, a person skilled in the art can make further variations and modifications to the embodiments. Therefore, the appended claims are intended to include preferred embodiments and all the variations and modifications falling in the scope of the present application.

It would be apparent that a person skilled in the art could make various modifications and variations to the present application without departing from The spirit or scope of the present application. If the various modifications and variations of the present application are in the scope of the claims of the present application or an equivalent technique thereof, the present application is intended to include the modifications and variations.

What is claimed is:

1. A quality determination method of a display panel, comprising the steps of:

generating a Gamma parameter adjusted by a Gamma adjustment device in a first format, wherein the first format is a format automatically generated by the Gamma adjustment device; and converting by the Gamma adjustment device the Gamma parameter in the first format into a second format, wherein the second format is a transmission format of the Gamma adjustment device and an equality determination device;

acquiring by the equality determination device, according to a preset transmission protocol, the Gamma parameter in the second format, wherein the equality determination and the Gamma adjustment device are not compatible;

parsing by the equality determination device the Gamma parameter in the second format into a third format, wherein the third format is a format conforming to the equality determination device; and generating an equality determination result according to preset Gamma parameters and the Gamma parameter in the third format, wherein the equality determination result comprises an equality determination result "pass" and an equality determination result "fail".

2. The quality determination method according to claim 1, wherein the step of generating an equality determination result according to preset Gamma parameters and the converted Gamma parameter comprises:

the preset Gamma parameters comprise a first Gamma parameter and a second Gamma parameter, wherein the first Gamma parameter is less than the second Gamma parameter;

when the adjusted Gamma parameter is greater than or equal to the first Gamma parameter and is less than or equal to the second Gamma parameter, generating an equality determination result "pass"; and when the adjusted Gamma parameter is less than the first Gamma parameter or is greater than the second Gamma parameter, generating an equality determination result "fail".

3. The quality determination method according to claim 1, wherein the data acquired by the equality determination device from the Gamma adjustment device comprises: the identity of the display panel, a Gamma value of the display panel before the adjustment, and adjustment time of the display panel.

4. The quality determination method according to claim 1, wherein after the step of generating an equality determination result according to preset Gamma parameters and the converted Gamma parameter, the method comprises:

storing the equality determination result;

displaying the equality determination result; and uploading the equality determination result to a server for backup.

5. The quality determination method according to claim 1, wherein before the step of acquiring by an equality determination device, according to a preset transmission protocol, a Gamma parameter adjusted by a Gamma adjustment device, the method comprises:

acquiring by the Gamma adjustment device the luminance and flicker data of the display panel;

converting the luminance and flicker data of the display panel into a Gamma parameter; and performing Gamma adjustment on the display panel according to the Gamma parameter.

6. A quality determination system of a display panel, comprising a memory, a processor, and a data processing program stored in the memory and capable of running on the processor; the data processing program when being executed by the processor performing the steps of the quality determination method as claimed in claim 1.

7. A non-transitory computer readable storage medium, wherein the non-transitory computer readable storage medium is stored with a data processing program; the data processing program when being executed by a processor performing the steps of the quality determination method as claimed in claim 1.

* * * * *